US006119386A

United States Patent [19]

Henry et al.

[11] Patent Number: 6,119,386

[45] Date of Patent: Sep. 19, 2000

[54] CERTIFICATION DISPLAY AND METHOD OF CONSTRUCTION THEREOF

[76] Inventors: James H. Henry, 186 Old Wick La., Inverness, Ill. 60067; Jeffrey J. Henry, 42W567 Steeplechase Ct., St. Charles, Ill. 60175

[21] Appl. No.: 09/332,521

[22] Filed: Jun. 14, 1999

[51] Int. Cl.[7] ..... A47G 1/06

[52] U.S. Cl. ..... 40/769; 40/772; 40/773; 40/768; 40/778; 40/735

[58] Field of Search ..... 40/769, 770, 771, 40/772, 773, 768, 777, 778, 735

[56] References Cited

U.S. PATENT DOCUMENTS

| | | | |
|---|---|---|---|
| D. 343,736 | 2/1994 | Ng . | |
| 3,125,460 | 3/1964 | Rose | 40/778 X |
| 3,382,595 | 5/1968 | Shore | 40/769 |
| 3,813,799 | 6/1974 | Caravello . | |
| 4,286,400 | 9/1981 | MacPherson . | |
| 4,709,495 | 12/1987 | Buckwalter . | |
| 4,777,746 | 10/1988 | Brooks | 40/773 |
| 5,005,869 | 4/1991 | Smith | 281/15.1 |
| 5,077,921 | 1/1992 | Mooney | 40/773 X |
| 5,150,792 | 9/1992 | Munroe . | |
| 5,286,558 | 2/1994 | Seo et al. | 40/768 X |
| 5,301,443 | 4/1994 | Gori . | |
| 5,383,293 | 1/1995 | Royal | 40/768 |
| 5,404,663 | 4/1995 | Schober | 40/768 |
| 5,419,062 | 5/1995 | Polinski . | |
| 5,502,912 | 4/1996 | LeBoff . | |
| 5,787,626 | 8/1998 | Bingham et al. | 40/735 |
| 5,918,398 | 4/1991 | Stanley et al. | 40/773 X |

*Primary Examiner*—Terry Lee Melius
*Assistant Examiner*—Rodrigo J. Morales
*Attorney, Agent, or Firm*—Meroni & Meroni; Charles F. Meroni, Jr.

[57] ABSTRACT

The certification display has a multilayer matting board including similarly sized first and second matting layers. The first matting layer is connected in coextensive overlaying relation to a front surface of the second matting layer. The multilayer matting board provides a predetermined location for the placement of a certification document or diploma and recertification labels. A certificate aperture for viewing a certificate, diploma or other certification documents extends through the matting board. The certificate aperture has a sufficient depth to act as a spacer between a front cover and the face of the certificate or diploma. A certificate, diploma, or other documentation is mounted on a back surface of the second matting layer in registry with the certificate aperture. A plurality of label wells extends through the first layer of the matting board. A recertification label is placed within the label wells, typically adhered to the bottom of the label well. The matting board is sandwiched in between a transparent front cover and a back cover. The front cover and the back cover are similarly sized to the matting board. The front cover, the matting board and the back cover are then disposed within a frame. The frame having a retaining means for keeping the front cover, the matting board and the back cover disposed within the frame and allowing easy removal of the back cover and the multilayer matting board without the use of tools for the purpose of adding additional recertification labels periodically.

21 Claims, 3 Drawing Sheets

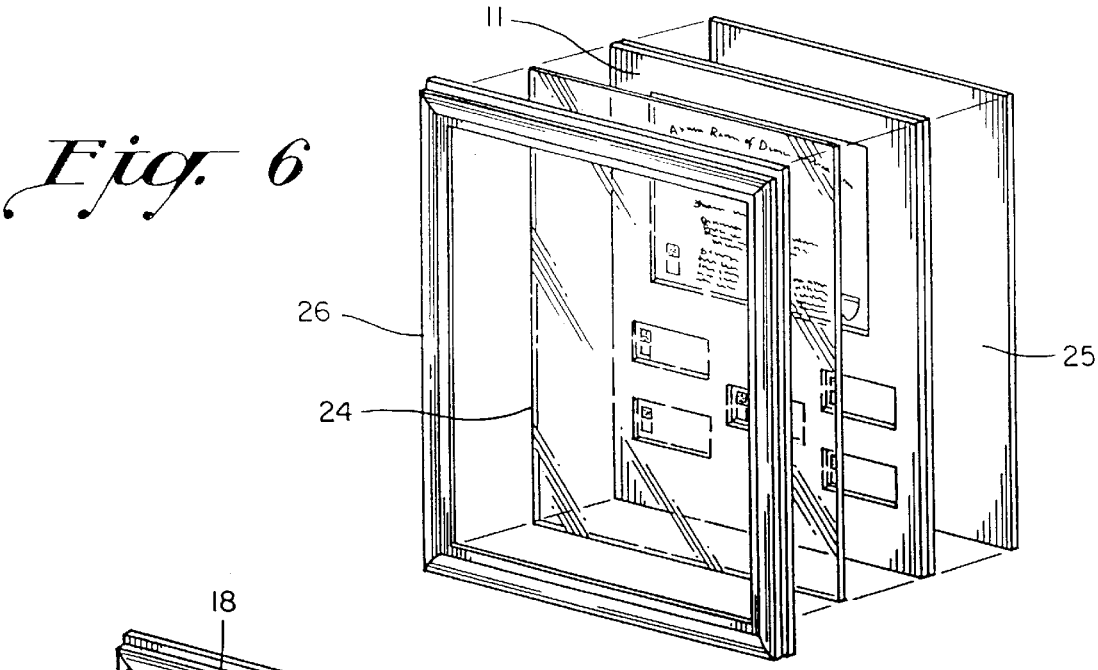
Fig. 6
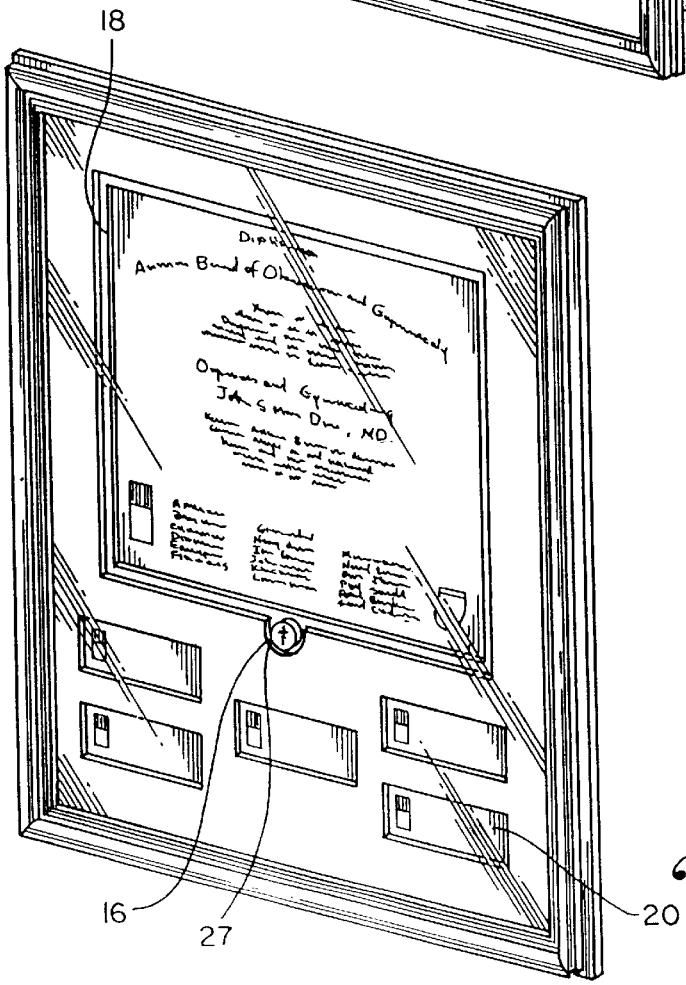
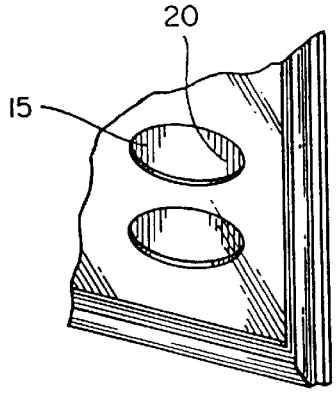
Fig. 7
Fig. 8

CERTIFICATION DISPLAY AND METHOD OF CONSTRUCTION THEREOF

FIELD OF THE INVENTION

The present invention relates to a decorative certification display for holding a certificate and a plurality of recertification labels and a method of constructing thereof.

DESCRIPTION OF THE PRIOR ART

In many professions, particularly in the medical field and also in some businesses, accreditation is required in order to practice that profession or business. To achieve accreditation the person or business must first successfully complete an initial accreditation process and they must often also continue to comply with a recertification process thereafter. In order to signify compliance with an accreditation process a certificate or diploma is typically given after being initially accredited and a recertification certificate or label is presented after successful recertification.

In most medical specialties, upon accreditation for a specific medical specialty, a certificate or diploma is given initially upon accreditation. Most medical specialty boards recertify their members every 6 to 10 years and issue a full size diploma indicating a particular period of time to signify compliance with the reaccreditation process. The diplomas are typically the same size as the original certificates given for first time certification. Recently, a major medical specialty board became the first medical specialty to offer recertification on an annual basis, versus every 6 to 10 years. While there are devices for displaying multiple pictures or diplomas in the prior art, these devices are not particularly suited physically and aesthetically for displaying a plurality of diplomas. Additionally, the individual doctor usually has a limited amount of wall space for displaying a new full size diploma if given annually.

To solve the above problem and to defray the cost of printing a full sized diploma annually, a miniature diploma or recertification label has been utilized to indicate a particular period of time of compliance with the reaccreditation process. These miniature recertification labels are typically made of strips of paper having an adhesive backing. Forgery resistant, decorative foilings and etchings on these recertification labels give the recertification labels thickness and a three dimensional quality which is diminished if a cover is placed directly on top of it. These recertification labels should be permanently displayed together at the place of business in order to signify to the clientele that the doctor has successfully completed the recertification process, and is currently recertified in his particular medical specialty.

One of the problems with the prior art is the fact that the certification paper and recertification labels come into direct contact with a lamination or cover. When the certificate and the recertification labels come in direct contact with a lamination or cover, humidity and other environmental factors will sometimes make the paper or the ink to stick to the lamination or cover, ruining the certificate or recertification label when they are taken out of the display device. With the need to display recertification labels, it is often necessary to remove the certificate or device annually to insert additional recertification labels. In order to preserve the integrity of the document, a cover is needed to offer some security against the diploma or label being removed or stolen, so the certificate or label must be inlaid in the display sufficiently spaced to keep the face of the documents from contacting a cover or lamination.

Another problem with the prior art is that it is often cumbersome to tear apart the display in order to insert and reposition new recertification labels. Typically, the insertion of a new recertification label will require the repositioning of previous labels and the certificate or diploma itself in order to properly insert a new recertification label. Consequently, it is important that the display be structured to allow for the easy insertion of additional recertification labels without the use of tools.

Accordingly, there is a need for a display device which is particularly suited for displaying a certificate or diploma and subsequent recertification labels.

Accordingly, there is also a need for a display device for displaying a certificate or diploma and subsequent recertification labels which will protect the integrity of the documents in the display.

Accordingly, there is also a need for a display device for displaying a certificate or diploma and subsequent recertification labels which can lend some security against theft of the diploma or certificate or the recertification labels.

Accordingly, there is also a need for a display device for displaying a certificate or diploma and subsequent recertification labels which will allow for the easy insertion of additional recertification labels.

The present invention is a decorative certification display for holding a certificate and a plurality of recertification labels and a method of constructing thereof As will be described in greater detail hereinafter, the present invention solves the aforementioned and employs a number of novel features that render it highly advantageous over the prior art.

SUMMARY OF THE INVENTION

Accordingly it is an object of this invention to provide a decorative display device especially suited for displaying a certificate or diploma and subsequent recertification labels.

Accordingly, it is also an object of this invention to provide a decorative display device which can protect a certificate or diploma and subsequent recertification labels against theft.

A further object of this invention is to provide a decorative display device for displaying a certificate or diploma and subsequent recertification labels which will allow for the easy insertion of additional recertification labels.

To achieve these objectives, and in accordance with the purposes of the present invention the following certification display for decoratively and securely displaying a certificate or diploma and recertification labels and the method of making thereof is presented.

The certification display has a multilayer matting board comprised of similarly sized first and second matting layers. The first matting layer is connected in coextensive overlaying relation to a front surface of the second matting layer. The multilayer matting board provides a predetermined location for the placement of a certification document or diploma and recertification labels.

A certificate aperture for viewing a certificate, diploma or other certification documents extends through the matting board. A certificate, diploma, or other documentation is mounted on a back surface of the second matting layer in registry with the certificate aperture. A means for holding or locating the certificate, diploma, or other documentation in registry with the certificate aperture is attached to the back surface of the second matting layer.

A plurality of label wells extends through the first layer of the matting board. A recertification label is placed within the label wells, typically adhered to the bottom of the label well.

Subsequent recertification labels are placed within their own label well until all the label wells have been utilized. Afterwards, subsequent recertification labels are placed within the label well of the oldest recertification label on the matting board covering the oldest recertification label.

The matting board is sandwiched in between a transparent front cover and a back cover. The front cover and the back cover are similarly sized to the matting board. The matting board acts as a protective spacer to keep the printed portion of the diploma or recertification documentation from being in direct contact with the front cover. The front cover, the matting board and the back cover are then disposed within a frame, the frame having a retaining means for keeping the front cover, the matting board and the back cover disposed within the frame.

The certification display is manufactured by first cutting a first aperture and a plurality of secondary apertures in the first matting layer and cutting a third aperture in the second matting layer. The third aperture is correspondingly positioned on the second matting layer as the first aperture on the first matting layer.

The first matting layer is then connected in coextensive, overlaying relation to a front surface of the second matting layer forming the multilayer matting board. The first and third aperture are then positioned in registry to each other forming a certificate aperture extending through the multilayer matting board. The secondary apertures form the sides, and the front surface of the second matting layer form the bottom of the plurality label wells on the multilayer matting board. The front cover, the matting board and the back cover are then disposed within the frame, the matting board being sandwiched in between the front and back cover.

Other objects, features, and advantages of the invention will become more readily apparent upon reference to the following description when taken in conjunction with the accompanying drawings.

BRIEF DESCRIPTION OF THE DRAWINGS

FIG. 6 is an exploded view of the certification display in FIG. 1.

FIG. 7 is a segmented view of a second embodiment of the certification display disclosing rounded label wells.

FIG. 8 is a top perspective view of the third embodiment of the certification display.

DESCRIPTION OF THE PREFERRED EMBODIMENT

Figure 1:
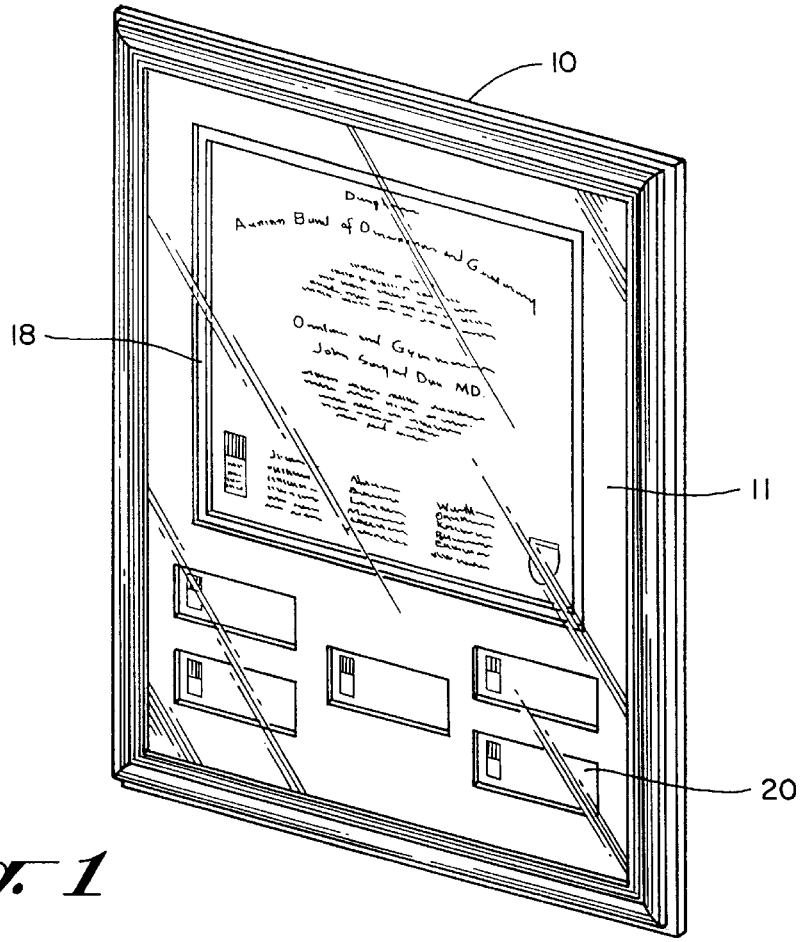
FIG. 1 is a top perspective view of the preferred embodiment certification display.
Figure 2:
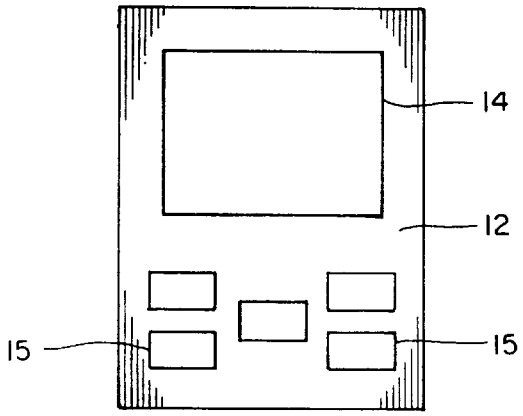
FIG. 2 is a planar view of the first matting layer.
Figure 3:
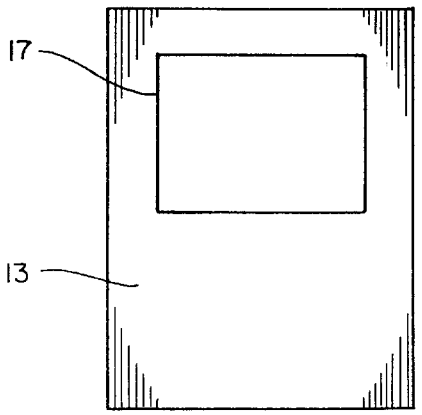
FIG. 3 is a planar view of the second matting layer.

The present invention is a certification display for decoratively displaying a certificate or diploma and recertification labels and the method of making thereof Referring to FIGS. 1, 2, 3, 7, and 8, the certification display 10 has a multilayer matting board 11 comprised of similarly sized first 12 and second 13 matting layers. In the preferred embodiment, both the first 12 and second 13 matting layers are made from pulp paper matboard, each preferably of different color, but other matting materials such as plastic or wood may also be used. The first 12 and second 13 matting layer are both preferably at least 1/16th of an inch thick in order to provide sufficient depth in the multilayer matting board. Additional layers of material may be inserted in between the first and second matting layers in order to add additional depth to the matting board.

The first matting layer 12 has a first aperture 14 and a plurality of secondary apertures 15 therethrough. In the preferred embodiment, the first aperture 14 and the secondary apertures 15 are parallelogram shaped. In a second embodiment of the invention, the secondary apertures 15 are rounded. In a third embodiment, the first matting layer 12 has a fourth aperture 16, preferably located just below the first aperture 14. The second matting layer has a third aperture 17 therethrough. The third aperture 17 is positioned on the second matting layer 13 to correspond to the position of the first aperture on the first matting layer 12.

Figure 4:
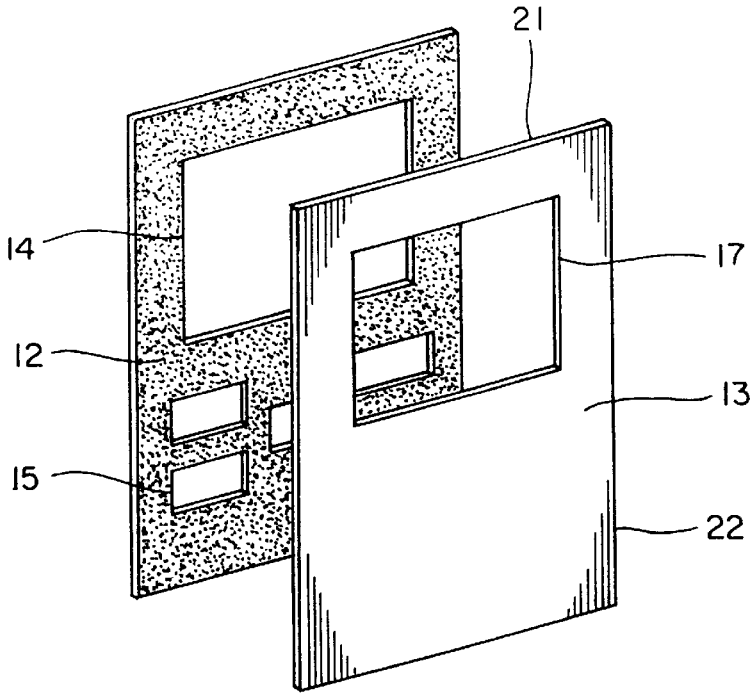
FIG. 4 is an exploded view of the multilayer matting board.

Referring to FIG. 4, the first matting layer is connected in coextensive overlaying relation to a front surface of the second matting layer, with the first aperture and the third aperture aligned in registry with each other. In the preferred embodiment of the present invention, the first matting layer is connected to the second matting layer by using an adhesive to adhere the first matting layer to the front surface of the second matting layer.

Figure 5:
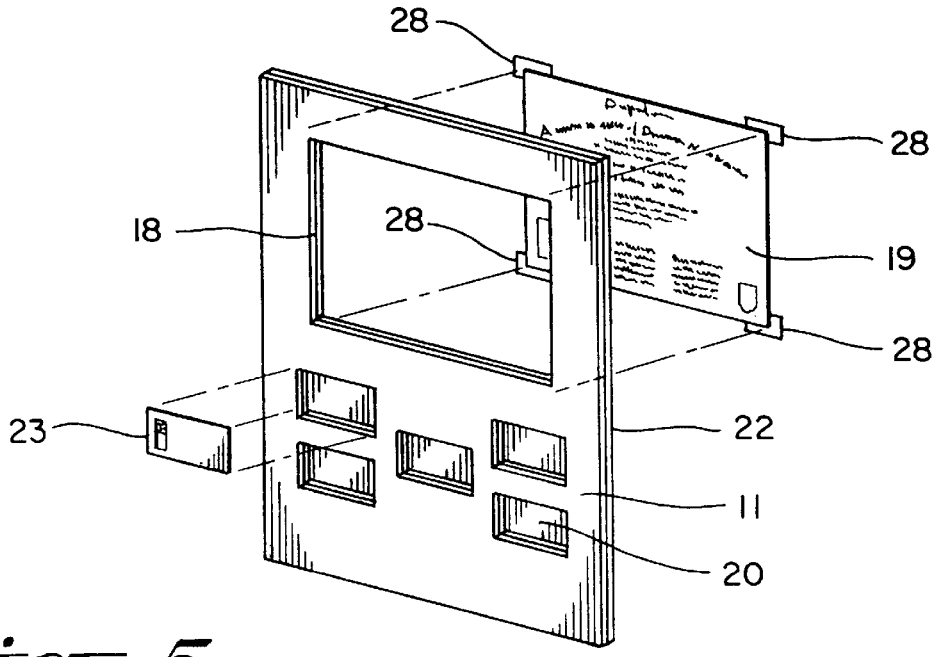
FIG. 5 is a top perspective of the multilayer matting board in FIG. 4 with a certificate and recertification label shown in an exploded view.

Referring to FIGS. 1, 5, and 8, the first aperture 14 on the first matting layer 12 and the third aperture 17 on the second matting layer 13 forms a certificate aperture 18 extending through the matting board for viewing a certificate 19, diploma or other certification documents through the multilayer matting board 11. A certificate, diploma, or other documentation is mounted on a back surface 22 of the second matting layer 13 in registry with the certificate aperture 18. A means for holding or locating 28 the certificate, diploma, or other documentation in registry with the certificate aperture is attached to the back surface 22 of the second matting layer. In the preferred embodiment, a tape means is utilized to locate the certificate, diploma or other documentation in registry with the certificate aperture.

Referring to FIGS. 4, 5 and 7, a plurality of label wells 20 is formed on the multilayer matting board 11 with the secondary aperture 15 forming the sides of the label wells 20 and the front surface 21 of the second matting layer forming the bottom of the label wells 20. The label wells are preferably at least 1/16th of an inch deep in order to allow for the insertion of more than one recertification label 23 within each well and to allow the recertification label to be inlaid within the multilayer matting board 11. The recertification labels typically have decorative and forgery resistant foiling and etchings which give the recertification labels thickness and a three dimensional quality which is diminished if a cover is placed directly upon it. A recertification label 23 is placed within the label wells 20, typically adhered to the bottom of the label well 20. Subsequent recertification labels are placed within their own label well 20 until all the label wells have been utilized. Afterwards, subsequent recertification labels are placed within the label well of the oldest recertification label on the matting board covering the oldest recertification label. Typically, a recertificaiton label is around 0.007 inches thick. In the preferred embodiment, there are four label wells 20 dedicated for the placement of recertification labels and one label well 20 to be used for the insertion of a purely decorative label, or "mission statement" of the medical specialty. At least 8 labels may be inlaid into a label well 20, allowing the preferred embodiment to handle at least 32 years of recertification.

Referring to FIGS. 6 and 8, in a third embodiment, a medallion well 27 is formed on the multilayer matting board 11 with the fourth aperture 16 forming the sides of the medallion well 27 and the front 21 surface of the second matting layer forming the bottom. The medallion well 27 is preferably $1/16^{th}$ of an inch deep and is typically used to display a pin or medal often given in certain occupations to signify completion of a training process or entry into a profession. The pin or medal is preferably adhesively mounted in the medallion well 27. Spacers need to be used between the front surface 21 of the second matting layer and the back surface 12 of the first matting layer to keep the pin or medal from reaching or scratching the front cover 24. These spacers are typically made of plastic, balsa wood or other nonacidic dense material.

Referring to FIG. 6, the matting board is sandwiched in between a transparent front cover 24 and a back cover 25. The front cover and the back cover are preferably similarly sized to the matting board. The matting board acts as a protective spacer to keep the printed portion of the diploma or recertification documentation from being in direct contact with the front cover 24. The front cover 24, the multilayer matting board 11 and the back cover 25 are then disposed within a frame 26, the frame having a retaining means for keeping the front cover, the matting board and the back cover disposed within the frame. Additional layers of material may be placed between the multilayer matting board 11 and the back cover 25 in order to fill the frame and prevent the matting board from moving within the frame.

Referring to FIGS. 1, 2 ,3 ,7 and 8 in the preferred embodiment, the certification display 10 is manufactured by first cutting the first aperture 14 and the plurality of secondary apertures 15 in the first matting layer 12 and cutting a third aperture 17 in the second matting layer 13. In the preferred embodiment and the third embodiment, the first 14, second 15 and third 17 apertures are cut to be parallelogram shaped, the secondary aperture preferably cut 4 inches wide and 2 inches high. In the second embodiment, the secondary apertures 15 are rounded. The third aperture 17 is positioned on the second matting layer 13 to correspond to the position of the first aperture 14 on the first matting layer 12. In a third embodiment of the present invention, a fourth aperture 16 is cut into the first matting layer preferably positioned just below the first aperture. In the preferred, second, and third embodiment, the sides of the first aperture 14, the secondary apertures 15, the third aperture 17, and the fourth aperture 16 are beveled so that the sides of the first 14, secondary 15, third 17 and fourth 16 apertures are angled.

Referring to FIGS. 4, 5, and 8 the first matting layer 12 is then positioned in coextensive, overlaying relation to a front surface 21 of the second matting layer 13, and in the preferred embodiment, adhered by an adhesive to the front surface 21 of the second matting layer 13 forming the multilayer matting board 11. The first 14 and third 17 apertures are positioned registry to each other forming a certificate aperture 18 extending through the multilayer matting board 11. The label wells 20 are formed on the multilayer matting board 11 with the secondary aperture 15 forming the sides of the label wells 20 and the front surface 21 of the second matting layer 13 forming the bottom of the label wells 20. In the third embodiment of the invention, the fourth aperture 16 and the front surface 21 of the secondary matting layer form a medallion well 27, with the fourth aperture 16 forming the sides of the medallion well 27 and the front surface 21 of the second matting layer 13 forming the bottom of the medallion well 27.

Referring to FIG. 6, the front cover 24 is then placed coextensively overlaying the multilayer matting board 11 and a back cover 25 is then placed coextensively beneath the multilayer matting board 11. The front cover 24, the multilayer matting board 11, and the back cover 25 are then disposed within the frame 26, the multilayer matting board 11 being sandwiched in between the front and back cover within the frame. Additional layers of material may be placed between the multilayer matting board 11 and the back cover 25 in order to fill the frame and prevent the multilayer matting board 11 from moving within the frame.

The invention described above is the preferred embodiment of the present invention. It is not intended that the novel device be limited thereby. The preferred embodiment may be susceptible to modifications and variations that are within the scope and fair meaning of the accompanying claims and drawings.

What is claimed is:

1. A certificate display for decoratively and securely displaying a certificate and recertification labels, the certificate display comprising:

a multilayer matting board, the matting board having a similarly sized first and second matting layer, the first matting layer connected in coextensive overlaying relation to a front surface of the second matting layer, a certificate aperture extending through the first and second layers for viewing a certificate through the board, and a plurality of label wells extending through the first layer, the label wells having uniform size and depth and smaller than the certificate aperture, the label wells providing a predetermined location for the placement of recertification labels;

the second matting layer providing a continuous backing behind the label wells;

a transparent front cover, the front cover similarly sized as the matting board;

a back cover, the back cover similarly sized as the matting board; and a frame, the transparent cover, the matting board, and the back cover disposed within the frame.

2. The certificate display in claim 1 wherein the certificate aperture and the label wells have beveled edges, and the label wells have a depth of at least $1/16^{th}$ of an inch.

3. The certificate display in claim 1 wherein the front surface of the second matting layer is a different color than the first matting layer.

4. The certificate display in claim 1 wherein the certificate aperture and the label wells are parallelogram shaped.

5. The certificate display in claim 1 wherein a medallion well extends through the first matting layer of the multilayer matting board, the medallion well having a depth of at least $1/16^{th}$ of an inch.

6. The certificate display in claim 1 wherein the label wells are rounded.

7. The certificate display in claim 1 further comprising a means for holding or locating a certificate in registry with the certificate aperture.

8. A medical certificate display for decoratively and securely displaying a medical certificate and medical recertification label, the medical certificate display comprising:

a matting board, the matting board having first and second layers, a certificate aperture for displaying a medical certificate through the board and a plurality of label wells extending through the first layer for adhesively disposing a recertification label therein, the label wells having uniform size and depth and being smaller than the certificate aperture; the second layer providing a continuous backing behind the label wells; and a frame, the matting board disposed within the frame.

9. The certificate display in claim 8 further comprising a means for locating a certificate in registry with the certificate aperture.

10. The certificate display in claim 8 wherein the certificate aperture and the label wells have beveled edges, and the label wells have a depth of at least $1/16^{th}$ of an inch.

11. The certificate display in claim 8 wherein the matting board has a medallion well.

12. The certificate display in claim 8 further comprising a transparent front cover, the front cover disposed within the frame.

13. The certificate display in claim 8 wherein the certificate aperture and the label wells are parallelogram shaped.

14. The certificate display in claim 8 wherein the label wells are rounded.

15. A certification display for decoratively and securely displaying compliance with an accreditation process, the certificate display comprising:

a certificate showing compliance with an accreditation process;

a plurality of certification labels displaying an indicia of accreditation for a particular period of time;

a multilayer matting board, the matting board having a similarly sized first and second matting layer, the first matting layer connected in coextensive overlaying relation to a front surface of the second matting layer, a certificate aperture extending through the first and second matting layers, the certificate spanning across the certificate aperture and mounted on a back surface of the second matting layer, and a plurality of label wells extending through the first layer, the recertification labels disposed therein;

the second matting layer providing a continuous backing behind the label wells;

a transparent front cover, the front cover similarly sized as the matting board;

a back cover, the back cover similarly sized as the matting board; and a frame, the transparent cover, the matting board, and the back cover disposed within the frame.

16. The certificate display in claim 15 wherein the certificate aperture and the label wells have beveled edges, and the label wells have a depth of at least $1/16^{th}$ of an inch.

17. The certificate display in claim 15 wherein the front surface of the second matting layer is a different color than the first matting layer.

18. The certificate display in claim 15 wherein the certificate aperture and the label wells are parallelogram shaped.

19. The certificate display in claim 15 wherein a medallion well extends through the first matting layer of the multilayer matting board, the medallion well having a depth of at least $1/16^{th}$ of an inch.

20. The certificate display in claim 15 wherein the label wells are rounded.

21. A certification display for decoratively and securely displaying compliance with an accreditation process, the certificate display comprising:

a certificate, the certificate having an indicia of compliance with an accreditation process;

a plurality of certification labels, the certification labels having an indicia of accreditation for a particular period of time;

a multilayer matting board, the matting board having a similarly sized first and second matting layer, the first matting layer connected in coextensive overlaying relation to a front surface of the second matting layer, a certificate aperture extending through the first and second layers, the certificate spanning across the certificate aperture and mounted on a back surface of the second matting layer, and a plurality of label wells extending through the first layer, the recertification labels disposed therein;

the second matting layer providing a continuous backing behind the label wells;

a transparent front cover, the front cover similarly sized as the matting board;

a back cover, the back cover similarly sized as the matting board; and a frame, the transparent cover, the matting board, and the back cover disposed within the frame.

* * * * *